United States Patent [19]

Parsons

[11] 4,043,001

[45] Aug. 23, 1977

[54] ADJUSTABLE SPRING HINGE

[75] Inventor: John S. Parsons, West Hartford, Conn.

[73] Assignee: The Stanley Works, New Britain, Conn.

[21] Appl. No.: 678,435

[22] Filed: Apr. 19, 1976

[51] Int. Cl.[2] ..... E05F 1/12

[52] U.S. Cl. ..... 16/189; 16/52; 16/183

[58] Field of Search ..... 16/189, 128 R, 54, 136, 16/134, 148, 168, 186, 180, 52, 183; 49/381

[56] References Cited

U.S. PATENT DOCUMENTS

| | | | |
|---|---|---|---|
| 36,976 | 11/1862 | Acker | 16/189 |
| 2,193,488 | 3/1940 | Morley et al. | 16/189 |
| 2,641,794 | | Raskin | 16/134 |
| 3,825,973 | 7/1974 | Gwozdz | 16/189 |
| 3,860,993 | 1/1975 | Mayuska | 16/52 |
| 3,898,708 | 8/1975 | Gwozdz | 16/189 X |
| 3,903,567 | 9/1975 | Suska | 16/189 |

*Primary Examiner*—G. V. Larkin
*Attorney, Agent, or Firm*—Brumbaugh, Graves, Donohue & Raymond

[57] ABSTRACT

An improved spring hinge includes a capstan for securing one end of a torsion spring in a knuckle of the hinge. To prevent axial movement of the capstan out of the hinge knuckle and permit axial alignment of a radial cavity in the capstan with an aperture in the hinge knuckle, the capstan is provided with a shoulder which engages a projection extending into the hinge knuckle. Also disclosed is a frangible pin which removably extends through the aperture into the cavity to secure the capstan against rotation relative to the hinge knuckle.

26 Claims, 10 Drawing Figures

FIG. 4
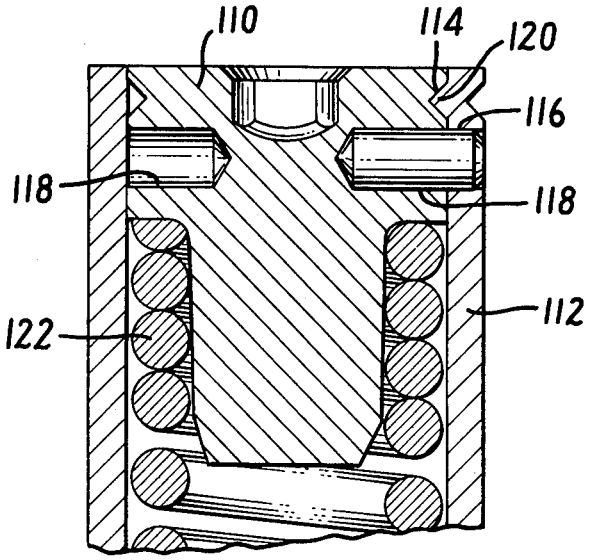
FIG. 5
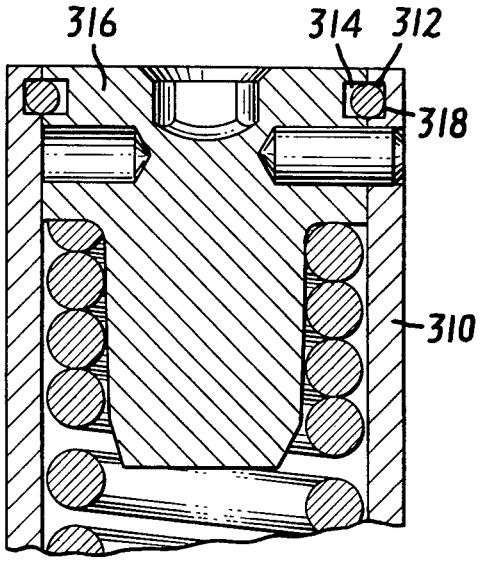
FIG. 7
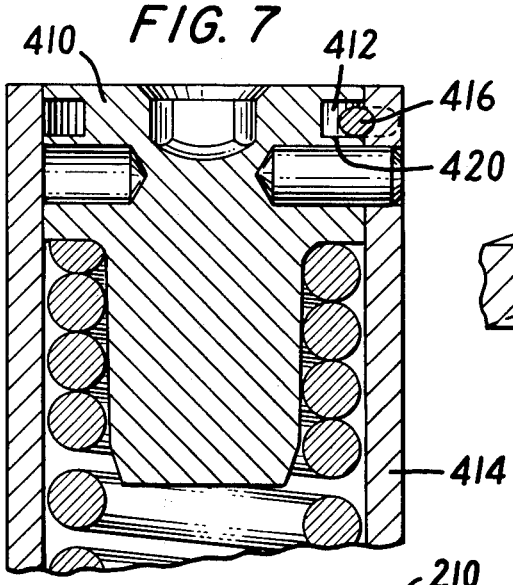
FIG. 6
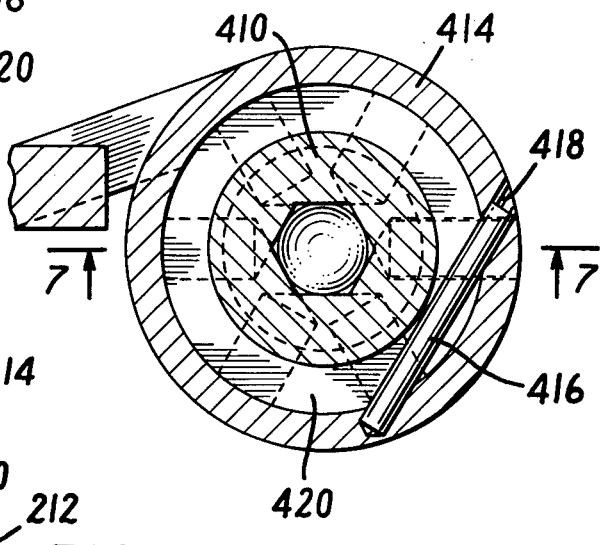
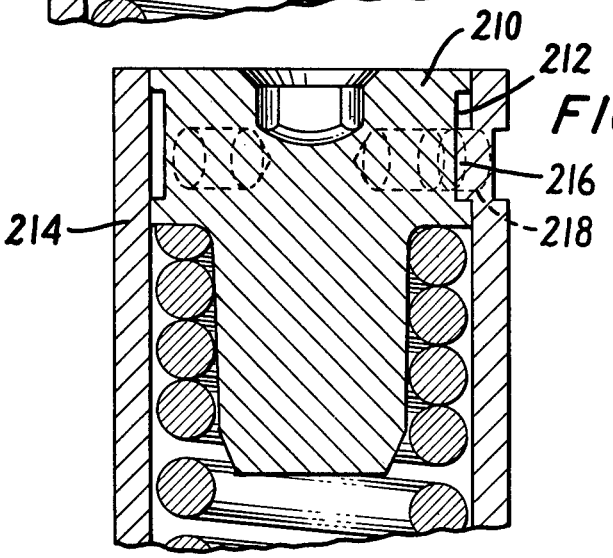
FIG. 8
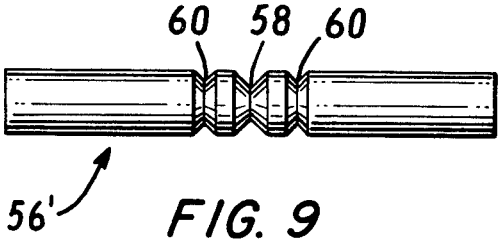
FIG. 9

ADJUSTABLE SPRING HINGE

FIELD OF THE INVENTION

The present invention relates to spring hinges, and, more particularly, to a spring hinge having an adjustable torsion spring.

BACKGROUND OF THE INVENTION

In recent years, some building codes have required new structures, for example, apartment houses, to include door closing devices on the entrance door of each housing unit. While in higher income units concealed hydraulic closing devices have been utilized, the requirements of the building codes can be satisfied by less expensive spring hinges.

Heretofore, spring hinges have been developed which meet the requirements of the building codes. A spring hinge is a hinge having within its tubular barrel a torsion spring which urges the door into a closed position. In U.S. Pat. No. 3,903,567 there is described a two knuckle spring hinge in which one end of the spring is non-rotatably supported by a capstan, which includes at least one radial cavity capable of being aligned with an aperture in a long hinge knuckle. A pin, adapted for insertion through the aperture and into the cavity, locks the capstan in place in the long hinge knuckle.

To adjust the torsion of the spring, the pin must be removed from the cavity and the capstan rotated. When the pin is removed, the capstan tends to be forced out of the long hinge knuckle by the spring, thereby necessitating axial as well as circumferential alignment of the cavity and aperture. Thus, in order to insert the pin through the aperture into the cavity, the capstan must be rotated and manually restrained from being pushed axially out of the long hinge knuckle.

The length of the pin is equal to the combined length of the cavity and aperture so that the pin does not extend externally of the long hinge knuckle. Although, in the past, spring hinges have utilized longer pins which extend outwardly from the hinge knuckles, those pins are disadvantageous because they detract from the aesthetic appearance of the hinge. On the other hand, the utilization of longer pins is advantageous, inasmuch as they are easier to insert and remove.

SUMMARY OF THE INVENTION

In accordance with the invention, there is provided a novel and improved spring hinge which normally includes a pair of adjacent hinge leaves, a pair of hinge knuckles formed respectively on adjacent edges of the hinge leaves, a pintle extending into the hinge knuckles for mounting them in axial alignment, a torsion spring mechanism for urging the hinge leaves together, and a capstan in one hinge knuckle for nonrotatably fixing one end of the torsion spring mechanism therein. In the hinge of the present inventio, the capstan has a radially extending cavity capable of being aligned with an aperture in the hinge knuckle and a generally circumferential shoulder engaging a projection extending into the hinge knuckle. By engaging the shoulder, the projection prevents the capstan from moving axially out of the hinge knuckle. The shoulder and projection are also designed in such a manner that the cavity and aperture are automatically aligned axially.

In one embodiment, the projection is formed by a ring secured in the aperture in the hinge knuckle and having an inner diameter of sufficient size to receive a pin for securing the capstan against rotation relative to the hinge knuckle. Thus, the present invention alleviates the need to manually restrain the capstan prior to insertion of the pin by automatically aligning the apertures axially. The ring may be frictionally secured in the aperture, in which case its manufacture from a compressible material facilitates insertion. Alternatively, the ring can be threaded into the aperture or bonded to the portion of the hinge knuckle delimiting the aperture.

In other embodiments, the projection is formed by a punch which is used to strike the exterior of the hinge knuckle causing a portion to be displaced interiorally. When the shoulder is formed by an annular channel in the capstan, the annular channel may be U-shaped or V-shaped depending upon the shape of the displaced portion. The projection may also be formed by a spring ring positioned partially in an annular groove in the hinge knuckle or a peg extending tangentially through the hinge knuckle.

To secure the capstan against rotation relative to the hinge knuckle, a removable pin extends through the aperture in the hinge knuckle and into the cavity in the capstan. The length of the pin is slightly greater than twice the combined length of the aperture and cavity so that slightly more than one-half of the pin extends outwardly from the hinge knuckle to facilitate insertion and removal of the pin. By providing the pin with a frangible midsection, a major portion of the pin extending outwardly from the hinge knuckle may be broken off after insertion. To ensure easy removal of the portion of the pin remaining in the aperture and cavity, a pair of grooves are formed on the pin, one on either side of the frangible midsection. The grooves provide a gripping surface which may be easily grasped by fingernails or the like. Moreover, the grooves facilitate the use of cutting pliers or the like to cut off the entire portion of the pin extending outwardly from the hinge knuckle so that removal of the portion of the pin remaining in the aperture and cavity is extremely difficult without special tools.

According to another aspect of the present invention, the capstan and pintle are provided with serrated portions engaging respective ends of the torsion spring mechanism to prevent their rotation relative to the capstan and pintle. By providing a serrated capstan and pintle, slippage of the torsion spring mechanism is prevented, even when wound to comparatively high torque values. Anchorage is greatly improved if the serrated portions are harder than the torsion spring mechanism so as to form and engage shallow grooves in the torsion spring mechanism.

Because of the increased gripping power of the serrated portions, both ends of the torsion spring mechanism may be provided with only a single anchoring turn for engaging respectively the capstan and pintle. Decreasing the number of anchoring turns required to grip the capstan and pintle is desirable because it allows an increase in the number of active turns. Since the capstan and pintle may be engaged by only a single anchoring turn, the portions of the capstan and pintle extending into the torsion spring mechanism may be shortened, thereby reducing the amount of material required to manufacture them.

BRIEF DESCRIPTION OF THE DRAWING

For a better understanding of the invention, reference may be made to the following description of five exemplary embodiments, taken in conjunction with the figures of the accompanying drawings, in which:

FIGS. 4–6 and 8 are axial cross-sectional views of alternate embodiments of the present invention;

FIG. 7 is a cross-sectional view of the embodiment of FIG. 6 taken along the line 7—7 of FIG. 6;

FIG. 9 is an elevational view of a frangible pin in accordance with the present invention.

DESCRIPTION OF THE PREFERRED EMBODIMENTS

Figure 1:
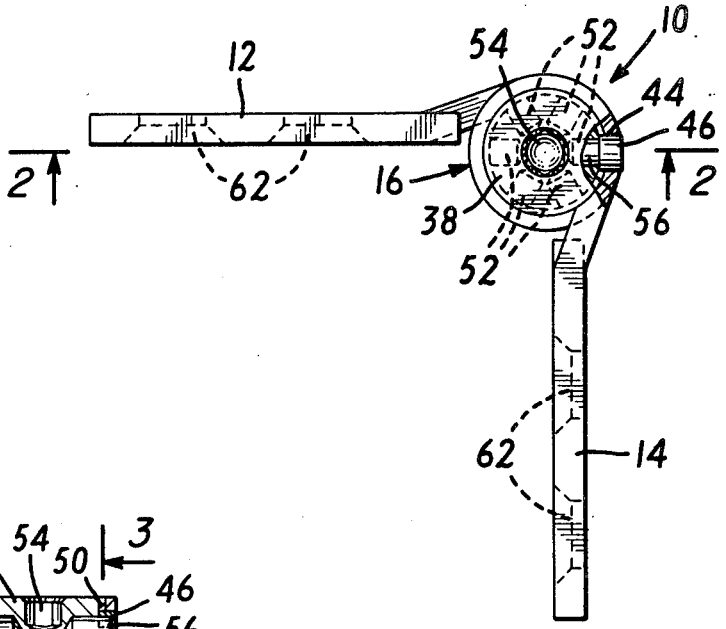
FIG. 1 is a top view of a spring hinge showing one embodiment of the present invention.
Figure 2:
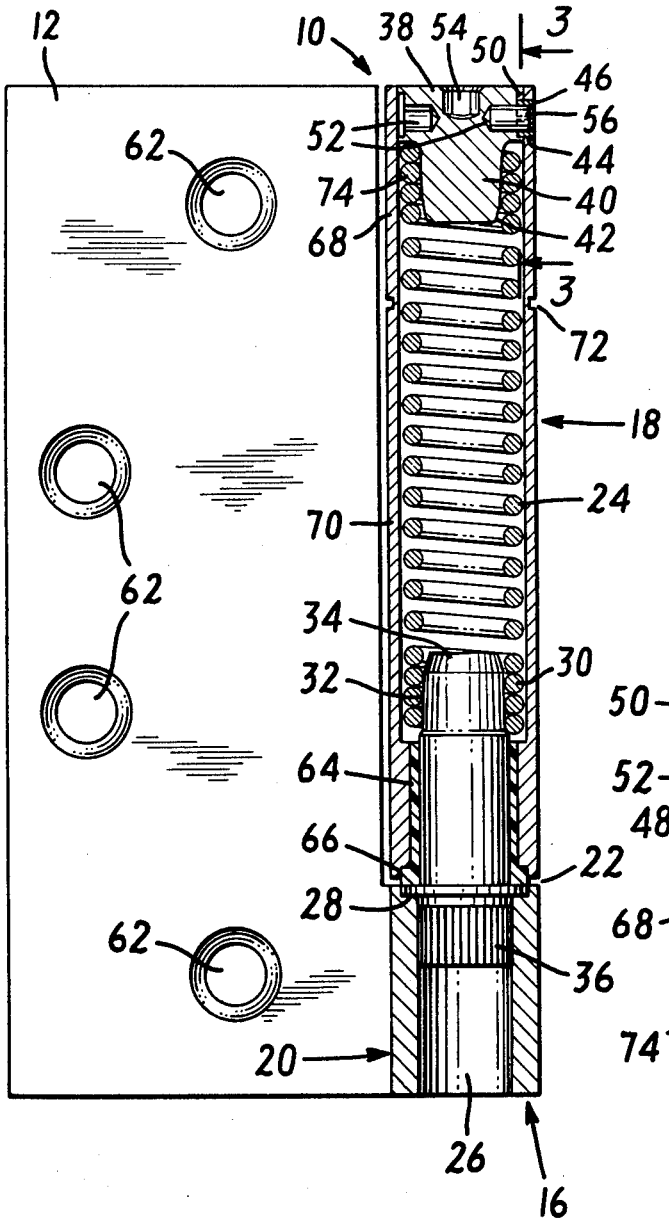
FIG. 2 is a cross-sectional view of the spring hinge of FIG. 1 taken along the line 2—2 of FIG. 1.
Figure 3:
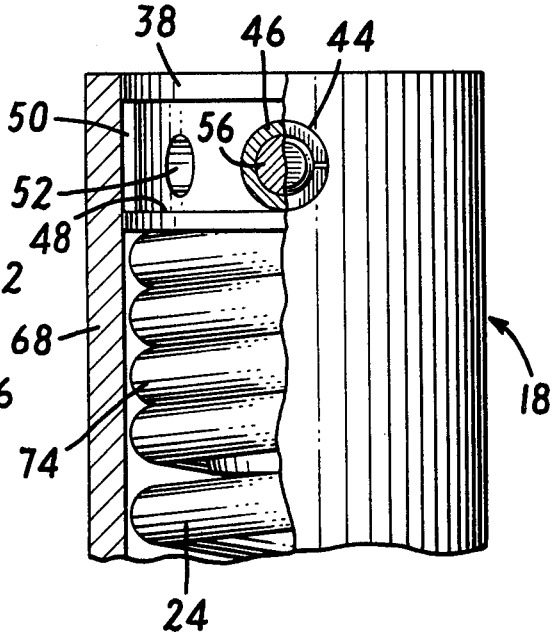
FIG. 3 is a partial cross-sectional view of the spring hinge of FIGS. 1 and 2 along line 3—3 of FIG. 2.

Referring generally to FIGS. 1–3, a spring hinge 10 embodying the present invention is shown. The spring hinge 10 comprises a first hinge leaf 12 and a second hinge leaf 14 with a central barrel 16 therebetween. The central barrel 16 is divided into a long or upper hinge kuckle 18 and a short or lower hinge knuckle 20 by a gap 22 formed by the juncture of the two knuckles. The short hinge knuckle 20 is formed at the edge of the first hinge leaf 12, and the long hinge knuckle 18 is formed at the edge of the second hinge leaf 14. The long hinge knuckle 18 receives a torsion spring 24 which may typically be a coil spring. The spring 24 tends to urge the hinge leaves 12 and 14 together. Thus a door supported by the hinge 10 is resiliently urged to its closed position.

A pintle 26 is press-fitted into place in the short hinge knuckle 20 until a flange 28 seats into a counterbore in the short hinge knuckle 20. The pintle 26 is then inserted into the long hinge knuckle 18. Since the pintle 26 is inserted prior to the attachment of the spring 24 thereto, the force required to insert the pintle 26 can be supplied by any suitable tool directly on the end of the pintle 26. This procedure avoids subjecting the spring 24 to the considerable force required to secure the pintle 26 to the short hinge knuckle 20. With the pintle 26 in place, the spring 24 is pressed into position on the pintle 26.

The spring 24 includes several closed turns 30 at its lower end for providing sufficient gripping power on the pintle 26. By utilizing a spring wound in a direction appropriate to the direction in which the hinge 10 opens, the closed turns 30 of the spring 24 grip the pintle 26 with increasing force as the spring torsion increases.

The spring 24 is secured to the pintle 26 by providing the end of the pintle 26 extending into the long hinge knuckle 18 with a tapered portion 32. A chamfer 34 at the end of the pintle 26 facilitates assembly of the spring 24 onto the pintle 26, while the tapered portion 32 of the pintle 26 expands the closed turns 30 of the spring 24. After the spring 24 is forced onto the pintle 26, the winding of the spring 24, to be described more fully hereinbelow, causes it to more tightly grip the pintle 26. A knurled portion 36 of the pintle 26 grips the interior of the short hinge knuckle 20 to secure the pintle 26 in the short hinge knuckle 20.

A capstan 38 positioned in the long hinge knuckle 18 is provided with a tapered portion 40 for securing the spring 24 to the capstan 38. A chamfer 42 at the end of the capstan 38 extending into the long hinge knuckle 18 facilitates insertion of the capstan 38 into the spring 24, while the tapered portion 40 of the capstan 38 expands several closed turns 74 formed at the upper end of the spring 24.

The long hinge knuckle 18 has a radially extending aperture 44 therethrough for receiving a split ring 46. The split ring 46 projects into the interior of the long hinge knuckle 18 and engages a shoulder 48 formed by an annular channel 50 in the capstan 38 to prevent axial movement of the capstan 38 out of the long hinge knuckle 18 and permit axial alignment of the aperture 44 with one of a plurality of cavities 52 in the capstan 38.

To wind the spring 24, the first hinge leaf 12 is held while a drive device cooperating with a recess 54 in the capstan 38, for example a hexagonal wrench inserted into a suitably formed recess, is used to rotate the capstan 38. After the spring 24 has been adjusted to the proper torque value, a pin 56 is inserted through the split ring 46 into one of the cavities 52 in the capstan 38 which is aligned axially and radially with the aperture 44 in the long hinge knuckle 18 to secure the capstan 38 against rotation relative to the long hinge knuckle 18. The torque on the pin 56 created by the spring 24 prevents its inadvertent movement.

The hinge leaves 12 and 14 are formed from a strong material, such as steel, and provided with a series of countersunk mounting holes 62 adapted to receive screws for mounting a door to a jamb. The first hinge leaf 12 with the short hinge knuckle 20 is attached to the jamb, while the second hinge leaf 14 is attached to the door. Thus, the short hinge knuckle 20 and the pintle 26 actually support the rest of the hinge 10 in a normal door installation.

An anti-friction bearing may be provided to enable free pivoting of the hinge leaves 12 and 14. In furtherance of this objective, the portion of the long hinge knuckle 18 adjacent the short hinge knuckle 20 is adapted to receive an anti-friction bushing 64. The bushing 64 is essentially a tubular member having a radially extending flange 66 at its lowermost end. The flange 66 of bushing 64 bears against the flange 28, which need not be integral with pintle 26, or directly against the short hinge knuckle 20 if the flange 28 is not used. The end of the long hinge knuckle 18 adjaccent the short hinge knuckle 20 is counterbored to accommodate the flange 66 of the bushing 64. Also, the internal surface of the bushing 64, which is disposed coaxially about the pintle 26, bears directly on the external surface of the pintle 26. Therefore the bushing 64, which is preferably manufactured out of an anti-friction plastic or other anti-friction material, provides both lateral and thrust bearing surfaces.

The appearance of the spring hinge 10 of the present invention is shown to simulate that of a concealed bearing hinge. Thus, the spring hinge 10 may be utilized aesthetically on a door which also utilizes conventional concealed bearing hinges. To simulate a three knuckle concealed bearing hinge, the length of the short hinge knuckle 20 is equal to that of an end knuckle of a like-sized three knuckle concealed bering hinge. The long hinge knuckle 18 has a length equal to that of an end and middle knuckle of a like-sized three knuckle concealed bearing hinge, and is divided into a stimulated upper hinge knuckle 68 and a simulated middle hinge knuckle 70 by a marking or groove 72 simulating a gap between knuckles. It will be understood thatadditional markings may be used to simulate hinges with, for example, five knuckles.

Referring generally to the alternate embodiments in FIGS. 4–8, there are shown various arrangements for maintaining a capstan in proper axial position within a knuckle of a hinge in accordance with the present invention. In the embodiment shown in FIG. 4, a capstan 110 mounted in the end of a hinge knuckle 112 is provided with an annular, V-shaped channel 114. In order to prevent axial movement of the capstan 110 in the hinge knuckle 112 and permit axial alignment of an aperture 116 in the hinge knuckle 112 with one of a plurality of cavities 118 in the capstan 110, a punch is used to strike the exterior of the hinge knuckle 112 causing a projection 120 to move into the channel 114 in the capstan 110. The projection 120 preferably engages the channel 114 as close as possible to the aperture 116. Otherwise, alignment of the aperture 116 and the cavity 118 is made difficult by a spring 122 which exerts an axial force on the capstan 110 tending to cock it at such an angle that the cavity 118 is thrown out of axial alignment with the aperture 116.

Similarly, in the embodiment shown in FIG. 8, a capstan 210 is provided with an annular U-shaped channel 212. A punch or similar tool is used to strike the exterior of a hinge knuckle 214 causing a projection 216 to be displaced into the channel 212 in the vicinity of an aperture 218 in the hinge knuckle 214.

In the embodiment of FIG. 5, the interior of a hinge knuckle 310 is provided with an annular channel 312 which is capable of being axially aligned with an annular channel 314 extending around the outer surface of a capstan 316. A spring ring 318 is housed in the channel 314 in the capstan 316. Since the spring ring 318 is resilient, it expands into the channel 312 in the hinge knuckle 310 when the channels 312 and 314 are aligned, thereby maintaining the capstan 316 in proper axial position.

Referring now to FIGS. 6 and 7, there is shown another embodiment in which a capstan 410 is provided with an annular channel 412. After the capstan 410 has been inserted into a hinge knuckle 414, a peg 416 is driven through an oblique hole 418 in the hinge knuckle 414 and across a portion of the interior of the hinge knuckle 414. The peg 416, which extends tangentially of the capstan 410, engages a shoulder 420 formed by the channel 412 in the capstan 410.

Figure 10:
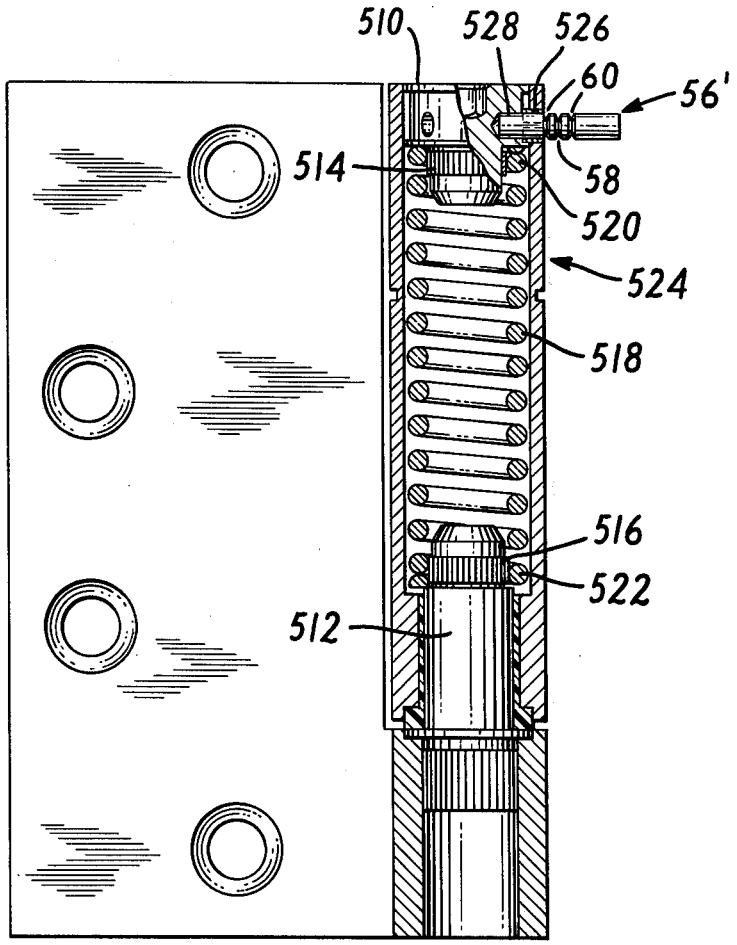
FIG. 10 is a cross-sectional view, similar to FIG. 2, of a spring hinge utilizing a pintle and capstan modified in accordance with the present invention.

As shown in FIG. 10, a capstan 510 and pintle 512 are provided with knurled or serrated portions 514 and 516, respectively. The knurled or serrated portions 514 and 516 include a multiplicity of asperities along an axial surface of a reduced diameter portion of the capstan 510 and the pintle 512, respectively. A spring 518 includes a single anchoring turn 520 wrapped substantially circumferentially about the reduced diameter portion of the capstan 510 so as to extend across and frictionally engage the asperities on the serrated portion 514 of the capstan 510. Another single anchoring turn 522 is wrapped substantially circumferentially about the reduced diameter portion of the pintle 512 so as to extend across and frictionally engage the asperities on the serrated portion 516 of the pintle 512. Because of the increased gripping power afforded by the serrated portions 514 and 516, slippage of the spring 518 is prevented, especially at high torque values of the spring. Since only a single anchoring turn is provided at both ends of the spring, the number of active turns is increased. Thus, the use of serrated capstans and pintles is particularly advantageous for smaller hinges which utilize correspondingly shorter springs having fewer active turns.

Referring now to FIGS. 9 and 10, there is shown a pin 56′ having a groove 58 about its midsection of such a depth that the pin 56′ may be broken in half easily. Since the pin 56′ is frangible about its midsection, the portion of the pin 56′ extending outwardly from a long hinge knuckle 524 (see FIG. 10) may be broken off after the pin 56′ has been inserted through a split ring 526 and into a cavity 528 in the capstan 510. To facilitate the insertion and removal of the pin 56′ after it has been broken in half, a pair of shallower grooves 60 are provided, one on either side of the groove 58, to form a surface which may be gripped, for example, by fingernails and the like. As explained above, the grooves 60 also facilitate the use of cutting pliers or the like to cut off the entire portion of the pin extending outwardly from the long hinge knuckle 524 so that removal of the portion of the pin in the cavity 528 is very difficult, unless special tools are used.

It will be understood that the above described embodiments are merely exemplary and that persons skilled in the art may make many variations and modifications without departing from the spirit and scope of the invention. All such modifications and variations are intended to be included within the scope of the invention as defined in the appended claims.

I claim:

1. A spring hinge comprising a pair of adjacent hinge leaves; first and second hinge knuckles formed respectively on adjacent edges of the hinge leaves, the first hinge knuckle having an aperture extending radially therethrough; a pintle extending into the hinge knuckles for mounting the knuckles in axial alignment; a torsion spring mechanism in the first hinge knuckle for urging the hinge leaves together, one end of the torsion spring mechanism being fixed for rotation relative to the first hinge knuckle; a capstan in the first hinge knuckle for non-rotatably fixing the other end of the torsion spring mechanism relative to the first hinge knuckle, the other end of the torsion spring mechanism having an anchoring turn wrapped substantially circumferentially about the capstan, the capstan having at least one radially extending cavity capable of being aligned with the aperture in the first hinge knuckle, a multiplicity of asperities disposed along an axial surface of the capstan, the anchoring turn of the torsion spring mechanism extending across and frictionally engaging the asperities to prevent rotation of the other end of the torsion spring mechanism relative to the capstan, and an annular channel forming a shoulder extending circumferentially around the capstan; and a ring secured in the aperture in the first hinge knuckle and extending into the first hinge knuckle for engaging the shoulder of the capstan to prevent axial movement of the capstan out of the first hinge knuckle and permit axial alignment of the aperture and cavity, the ring having an inner diameter of sufficient size to receive a pin for securing the capstan against rotation relative to the first hinge knuckle.

2. A spring hinge comprising a pair of adjacent hinge leaves; first and second hinge knuckles formed respectively on adjacent edges of the hinge leaves, the first hinge knuckle having an aperture extending radially therethrough; a pintle extending into the hinge knuckles for mounting the knuckles in axial alignment; a torsion spring mechanism in the first hinge knuckle for urging the hinge leaves together, one end of the torsion spring mechanism being fixed for rotation relative to the first hinge knuckle; a capstan in the first hinge knuckle for non-rotatably fixing the other end of the torsion spring mechanism relative to the first hinge knuckle, the capstan having at least one radially extending cavity capable of being aligned with the aperture in the first hinge knuckle and an annular channel forming a shouler extending circumferentially around the capstan; and a projection formed by a displaced portion of the first hinge knuckle and extending into the first hinge knuckle for engaging the shoulder to prevent axial movement of the capstan out of the first hinge knuckle and permit axial alignment of the aperture and cavity, wherein a pin may be inserted through the aperture and into the cavity for securing the capstan against rotation relative to the first hinge knuckle.

3. A spring hinge according to claim 2, wherein the annular channel is U-shaped.

4. A spring hinge according to claim 2, wherein the annular channel is V-shaped.

5. A spring hinge comprising a pair of adjacent hinge leaves; first and second hinge knuckles formed respectively on the adjacent edges of the hinge leaves, the first hinge knuckle having an aperture extending radially therethrough; a pintle extending into the hinge knuckles for mounting the knuckles in axial alignment; a torsion spring mechanism in the first hinge knuckle for urging the hinge leaves together, one end of the torsion spring mechanism being fixed for rotation relative to the first hinge knuckle; a capstan in one end of the first hinge knuckle for non-rotatably fixing the other end of the torsion spring mechanism relative to the first hinge knuckle, the other end of the torsion spring mechanism having an anchoring turn wrapped substantially circumferentially about the capstan, the capstan having at least one radially extending cavity capable of being aligned with the aperture in the first hinge knuckle, a multiplicity of serrations extending substantially axially along the capstan and engaging the anchoring turn of the other end of the torsion spring mechanism to prevent rotation of the other end of the torsion spring mechanism relative to the capstan, and a shoulder extending circumferentially around the capstan; a ring secured in the aperture in the first hinge knuckle and extending into the first hinge knuckle for engaging the shoulder to prevent axial movement of the capstan out of the first hinge knuckle and permit axial alignment of the aperture and cavity; and a pin removably extending through the ring into the cavity for securing the capstan against rotation relative to the first hinge knuckle.

6. A spring hinge according to claim 5, wherein the one end of the torsion spring mechanism has an anchoring turn wrapped substantially circumferentially about the pintle; and wherein the pintle includes a multiplicity of serrations extending substantially axially along the pintle and engaging the anchoring turn of the one end of the torsion spring mechanism to prevent rotation of the one end of the torsion spring mechanism relative to the pintle.

7. A spring hinge according to claim 6, wherein the torsion spring mechanism includes, at both ends, a single anchoring turn.

8. A spring hinge comprising a pair of adjacent hinge leaves; first and second hinge knuckles formed respectively on the adjacent edges of the hinge leaves, the first hinge knuckle having an aperture extending radially therethrough; a pintle extending into the hinge knuckles for mounting the knuckles in axial alignment; a torsion spring mechanism in the first hinge knuckle for urging the hinge leaves together, one end of the torsion spring mechanism being fixed for rotation relative to the first hinge knuckle; a capstan in one end of the first hinge knuckle for non-rotatably fixing the other end of the torsion spring mechanism relative to the first hinge knuckle, the other end of the torsion spring mechanism having an anchoring turn wrapped substantially circumferentially about the capstan, the capstan having at least one radially extending cavity capable of being aligned with the aperture in the first hinge knuckle, a multiplicity of serrations extending substantially axially along the capstan and engaging the anchoring turn of the torsion spring mechanism to prevent rotation of the other end of the torsion spring mechanism relative to the capstan, and a shoulder extending circumferentially around the capstan; a projection extending into the first hinge knuckle for engaging the shoulder to prevent axial movement of the capstan out of the first hinge knuckle and permit axial alignment of the aperture and cavity; and a pin removably extending through the aperture into the cavity for securing the capstan against rotation relative to the first hinge knuckle, the pin having a portion extending outwardly from the first hinge knuckle, the outwardly extending portion of the pin being frangible such that at least a segment of the outwardly extending portion may be broken off.

9. A spring hinge comprising a capstan with a reduced diameter portion extending substantially axially into a knuckle of the hinge for securing one end of a torsion spring mechanism in the hinge knuckle, the one end of the torsion spring mechanism having an anchoring turn wrapped substantially circumferentially about the reduced diameter portion; an aperture formed in the hinge knuckle, the capstan including at least one radial cavity capable of being aligned with the aperture in the hinge knuckle and a multiplicity of asperities disposed along an axial surface of the reduced diameter portion, the anchoring turn of the torsion spring mechanism extending across and frictionally engaging the asperities to prevent rotation of the one end of the torsion spring mechanism relative to the capstan; and detent means for preventing axial movement of the capstan out of the hinge knuckle and permitting axial alignment of the cavity and aperture.

10. A spring hinge according to claim 9, wherein the one end of the torsion spring mechanism includes a single anchoring turn,

11. A spring hinge according to claim 9, wherein the asperities are made from a harder material than the torsion spring mechanism, whereby the asperities form and engage shallow depressions in the anchoring turn of the torsion spring mechanism to improve anchorage of the torsion spring mechanism to the capstan.

12. A spring hinge according to claim 9, wherein the asperities are serrations extending substantially axially along and radially outwardly from the reduced diameter portion of the capstan.

13. A spring hinge according to claim 9, wherein the asperities are part of a knurled section on the reduced diameter portion of the capstan.

14. A spring hinge according to claim 9, wherein the detent means includes a projection extending into the hinge knuckle and a circumferential shoulder on the capstan, the shoulder engaging the projection substantially adjacent the hinge knuckle to prevent axial movement of the capstan out of the hinge knuckle and permit axial alignment of the cavity and aperture.

15. A spring hinge according to claim 14, wherein the projection includes a ring secured in the aperture in the hinge knuckle, the ring having an inner diameter of sufficient size to receive a pin for securing the capstan against rotation relative to the hinge knuckle.

16. A spring hinge according to claim 15, wherein the ring is compressible so that it may be compressed for insertion into the aperture and expanded for frictional engagement in the aperture.

17. A spring hinge according to claim 14, wherein the projection is formed by a displaced portion of the hinge knuckle.

18. A spring hinge according to claim 14, wherein the projection is a spring ring positioned partially in an annular groove in the hinge knuckle.

19. A spring hinge according to claim 14, wherein the projection is a peg extending tangentially through the hinge knuckle.

20. A spring hinge according to claim 14, further a pin removably extending through the aperture into the cavity for securing the capstan against rotation relative to the hinge knuckle.

21. A spring hinge according to claim 20, wherein the length of the pin is slightly greater than twice the combined length of the aperture and cavity, whereby slightly more than one-half of the pin extends outwardly from the hinge knuckle to facilitate insertion and removal of the pin.

22. A spring hinge according to claim 21, wherein the pin has a frangible midsection, whereby at least a major portion of the pin extending outwardly from the hinge knuckle may be broken off.

23. A spring hinge according to claim 22, wherein the pin includes a pair of grooves, one adjacent either side of the frangible midsection, to provide a gripping surface for facilitating removal and insertion of the pin after the pin has been broken in half.

24. In a spring hinge comprising a capstan for securing one end of a torsion spring mechanism in a knuckle of the hinge; an aperture formed in the hinge knuckle; and a projection extending into the hinge knuckle, the capstan including at least one radial cavity capable of being aligned with the aperture in the hinge knuckle and a circumferential shoulder engaging the projection to prevent axial movement of the capstan out of the hinge knuckle and permit axial alignment of the cavity and aperture; the improvement wherein the projection is a displaced portion of the hinge knuckle.

25. In a spring hinge comprising a capstan for securing one end of a torsion spring mechanism in a knuckle of the hinge; an aperture formed in the hinge knuckle; and a projection extending into the hinge knuckle, the capstan including at least one radial cavity capable of being aligned with the aperture in the hinge knuckle and a circumferential shoulder engaging the projection to prevent axial movement of the capstan out of the hinge knuckle and permit axial alignment of the cavity and aperture; the improvement wherein the projection is a spring ring positioned partially in an annular groove in the hinge knuckle.

26. In a spring hinge comprising a capstan for securing one end of a torsion spring mechanism in a knuckle of the hinge; an aperture formed in the hinge knuckle; and a projection extending into the hinge knuckle, the capstan including at least one radial cavity capable of being aligned with the aperture in the hinge knuckle and a circumferential shoulder engaging the projection to prevent axial movement of the capstan out of the hinge knuckle and permit axial alignment of the cavity and aperture; the improvement wherein the projection is a peg extending tangentially through the hinge knuckle.

* * * * *

UNITED STATES PATENT AND TRADEMARK OFFICE

CERTIFICATE OF CORRECTION

PATENT NO. : 4,043,001

DATED : August 23, 1977

INVENTOR(S) : John S. Parsons

It is certified that error appears in the above-identified patent and that said Letters Patent are hereby corrected as shown below:

First page, Item [56], after "2,641,794" insert --6/1953--;

Col. 1, line 57, "inventio" should read --invention--;

Col. 4, line 63, "stimulated" should read --simulated--;

Col. 4, line 66, "thatadditional" should read --that additional--;

Col. 7, line 6, "shouler" should read --shoulder--; and

Col. 9, line 20, after "further" insert --comprising--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*